United States Patent [19]

Abram

[11] 4,307,880

[45] Dec. 29, 1981

[54] DEVICE FOR YOGA EXERCISING

[76] Inventor: Gin Y. Abram, 1630 E. 102nd St., Apt. 8-E, Brooklyn, N.Y. 11236

[21] Appl. No.: 851,624

[22] Filed: Nov. 15, 1977

[51] Int. Cl.[3] ..... A63B 23/00

[52] U.S. Cl. ..... 272/146; 272/143; 272/DIG. 4; 272/93

[58] Field of Search ..... 272/109, 112, 134, 144, 272/DIG. 4, 127, 113, 93, 143

[56] References Cited

U.S. PATENT DOCUMENTS

| | | | |
|---|---|---|---|
| 2,512,911 | 6/1950 | Benice | 272/134 |
| 2,930,430 | 3/1960 | Bloom | 272/144 X |
| 3,586,321 | 6/1971 | Gehrke | 272/109 X |
| 3,780,469 | 12/1973 | Hancovsky | 272/56.5 R X |
| 4,084,815 | 4/1978 | Flannery | 272/144 X |

FOREIGN PATENT DOCUMENTS

| | | | |
|---|---|---|---|
| 1200181 | 9/1965 | Fed. Rep. of Germany | 272/109 |

*Primary Examiner*—Richard C. Pinkham
*Assistant Examiner*—William R. Browne
*Attorney, Agent, or Firm*—Ilya Zborovsky

[57] ABSTRACT

A device for exercising Yoga has an elongated resiliently deformable element movable between a first position in which it is concave so that a practitioner resting on the inside of said elements would assume a bow-like posture. A connecting device is positioned inside the concave structure to connect the ends thereof so that the deformable element will retain its shape.

9 Claims, 11 Drawing Figures

DEVICE FOR YOGA EXERCISING

BACKGROUND OF THE INVENTION

It is well known that a Yoga practitioner must assume respective postures for performing respective Yoga exercises. However, up to now Yoga practitioners have assumed respective postures by themselves without the aid of specific devices. This possesses essential disadvantages which will be described hereinbelow. The Yoga exercises assure medical and restoring action only in the case when they are correctly performed. Sinc the Yoga exercises are substantially complicated to be performed, a person which is going to start exercising encounters many difficulties. Such person may have no time for lengthy studying, the user may not be sufficiently persistent, and may not have a trainer for providing competent help, many hours are usually necessary in order to arrive at correct postures. Furthermore interruptions in studying make the process even more complicated and return the practitioner back to initial condition. Execessive weight or age may also be a deterrent to practicing Yoga exercises.

SUMMARY OF THE INVENTION

Accordingly, it is an object of the present invention to provide a device for Yoga exercising and a method of forming the same which make Yoga exercises more accessible for practitioners.

More particularly, it is an object of the present invention to provide a device for Yoga exercising so that yoga exercises may be correctly executed substantially independently from practitioner's age, weight, inclination and ability for exercising, persistance, interruptions in mastering the exercises, and without a trainer.

Another object of the present invention is to provide a device for Yoga exercising which has a simple construction and is easy and inexpensive to manufacture.

In keeping with these objects, and with others which will become apparent hereinafter, one feature of the present invention resides in a device for Yoga exercising which has a resiliently deformable element movable between a first position in which it is concave so that a practitioner resting on said element from inside assumes a bow-like posture.

When the practitioner executes Yoga exercises with the aid of the above device he or she does not need to be preliminarily trained and can immediately execute the Yoga exercises. This possibility does not depend on practitioner's weight, age, inclination and ability for exercising, persistance interruptions in exercising and the like. The practitioner does not need to be taught by a trainer. During short time he or she will be convinced in the fact that the device is simple and helpful, and he or she is able to improve his or her health by Yoga exercising.

Still another object of the present invention is that retaining means is provided for retaining the resiliently deformable element in a respective position, which means may include an elongated connecting element connecting the ends of the deformable element. The connecting element may be adjustable in the direction of elongation thereof so as to vary its length in order to connect respective portions of the resiliently deformable element and to vary curvature of the later. Such adjustable connecting element may include two sections telescopically movable relative to one another and fixable in a plurality of positions. The connecting element has a rigidity exceeding the rigidity of the resiliently deformable element.

A further object of the present invention is that the connecting element may rigidly connect end portions of the resiliently deformable element with one another. The connecting element also may rigidly connect one of the end portions of the resiliently deformable element with a section located intermediate another end portion and a central plane of the reciliently deformable element. In the later case, the connecting element may be connected with the above section in a plurality of positions spaced from one another so that curvature of the resiliently deformable element can be varied. Both the above connections may be used simultaneously and together.

A still further object of the present invention is that the resiliently defomable element may have two or more separate members connectable with one another so as to form together the resiliently deformable element. When the members are disconnected from one another the device will be more compact and convenient for transportation.

An additional object of the present invention is that the resiliently deformable element may have a rectilinear contour in a initial position. It is also possible that the resiliently deformable element is curved in its inital position.

Other objects, features and advantages of the present invention will become apparent from the subsequent description, taken in conjunction with the accompanying drawings.

DESCRIPTION OF PREFERRED EMBODIMENTS

Yoga exercising device in accordance with the present invention has a resiliently deformable element I which may be constituted of any material having the above characterstic.

Figure 1:
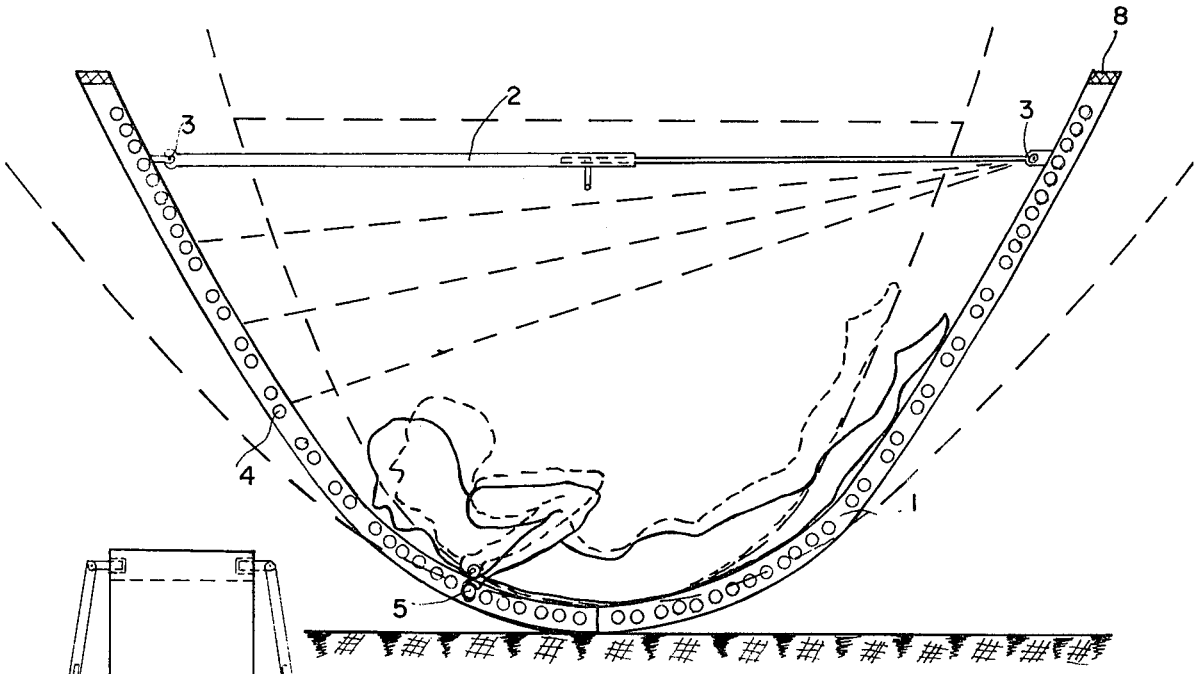
FIG. 1 is a view showing a Yoga exercising device in a first position.
Figure 1A:
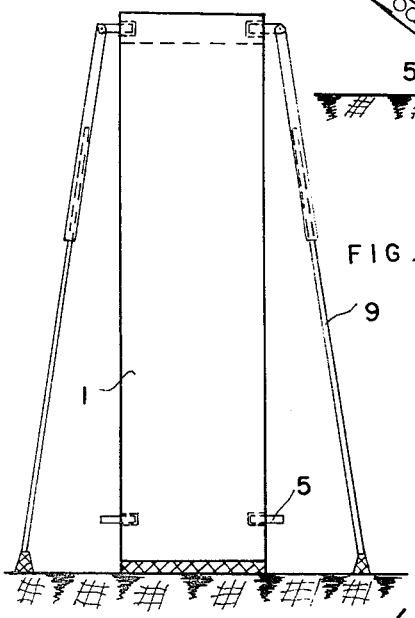
FIG. 1*a* is a view of the device of FIG. 2.

The deformable element 1 can be bent so as so assume a concave contour, as shown in FIG. 1 of the drawing. A connecting element 2 retains the deformable element 1 in this position. The connecting element 2 is detachably connected to the deformable element 1 so that one end portion of the former is connected to one end portion of the latter, whereas another end portion of the connecting element 2 may be connected to the deformable element I in one of a plurality of locations spaced from one another, as indicated in solid and broken lines in FIG. I. Thus, the deformable member I can have different radii of curvature, and different resiliency of the latter. The connecting element 2 is connected to the deformable element 1 by conventional means, such as pivot means 3 showen in FIGS. 1, 2.

When the practitioner places his or her body inside the concave deformable element 1, he or she can assume a bow-like posture or Dhanurasana. In this posture the practitioner can perform swinging motions together with the resiliently deformable element. At the same time since the resiliently deformable element can be bent, the practitioner's body may be additionally bent so as to improve exercising.

Figure 9:
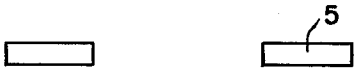
FIG. 9 is a view showing handles detachable connectable with the resiliently deformable element of the Yoga exercising device.

The deformable element 1 has a plurality of bores 4 spaced from one another in the direction of elongation thereof, in each of which bores 4 handles 5 shown in FIG. 9 may be detachably inserted. By means of the handles 5 the practitioner can vary stress applied thereto during of the Yoga exercise.

Figure 2:
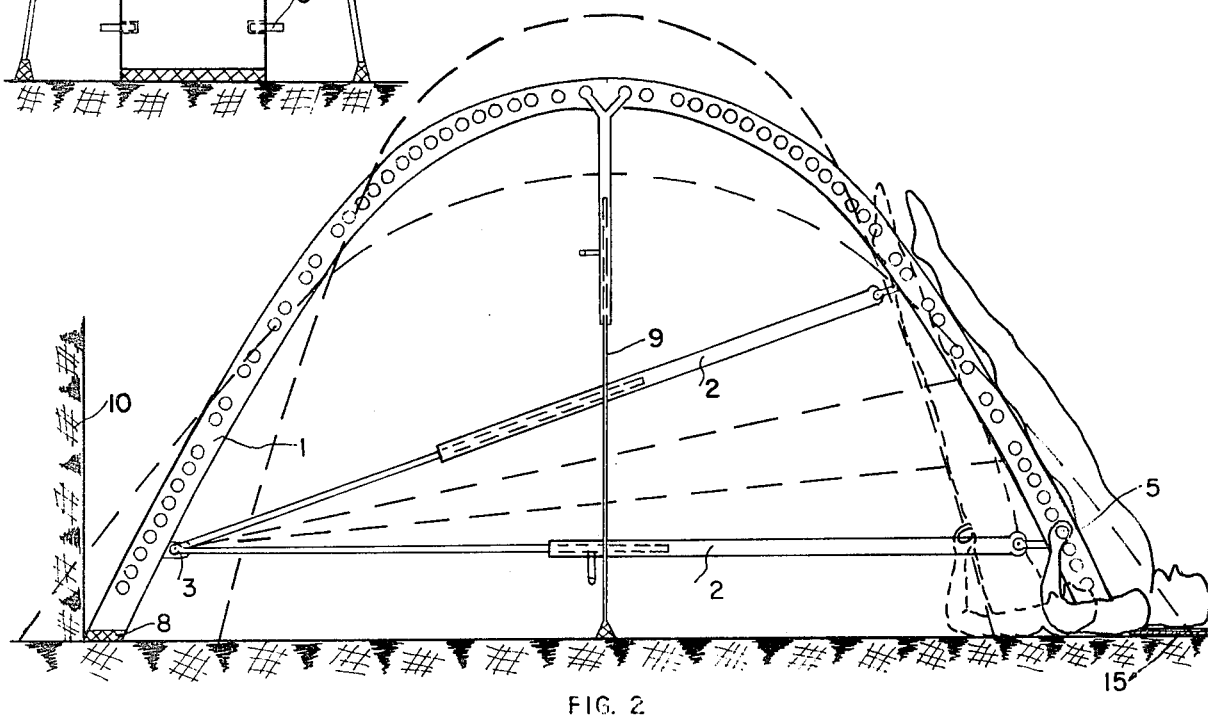
FIG. 2 is a view showing the Yoga exercising device in a second position.

As shown in FIG. 2 the resiliently deformable element 1 is bent so as to assume a convex contour. The connecting element 2 retains the deformable element 1 in this position similarly to the position shown in FIG. 1. It is also possible to provide in the device at least two such connecting elements. In this case, one of the connecting element may connect the end portions of the resiliently deformable element 1, whereas another connecting element may connect one of the end portion of the resiliently deformable element 1 with a section thereof located between the other end portion end the central plane of the resiliently deformable element 1. The practitioner places his body outside the convex deformable element 1 so that he or she can assume a candle-like posture. The above handles 5 may be inserted in the bores 4 located adjacent to end portion of the deformable element 1 so that the practitioner can grasp the handles and assume as wellas reliably retain himself or herself in this position. The end portions of the deformable element 1 may have leg sections 8, and spreaders 9 may be provided so as to support the device in stable condition. The device may abut against a wall 10 of the living unit.

Figure 3:
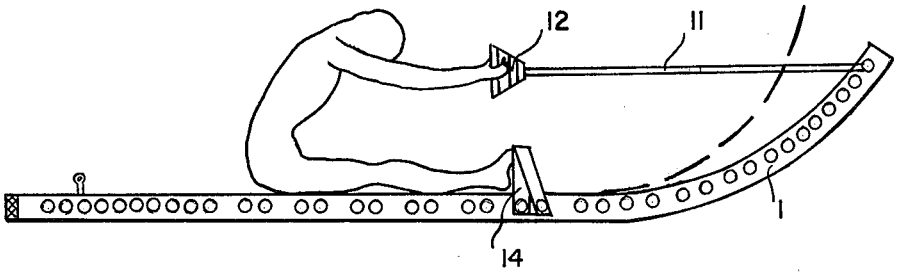
FIG. 3 is a view showing the Yoga exercising device in a third position.
Figure 4:
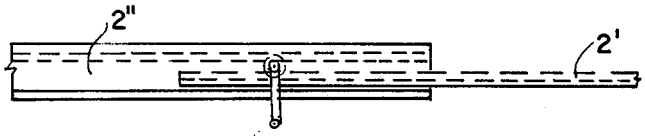
FIG. 4 is a view showing a connecting element including two sections movable relative to and connectable with one another.
Figure 5:
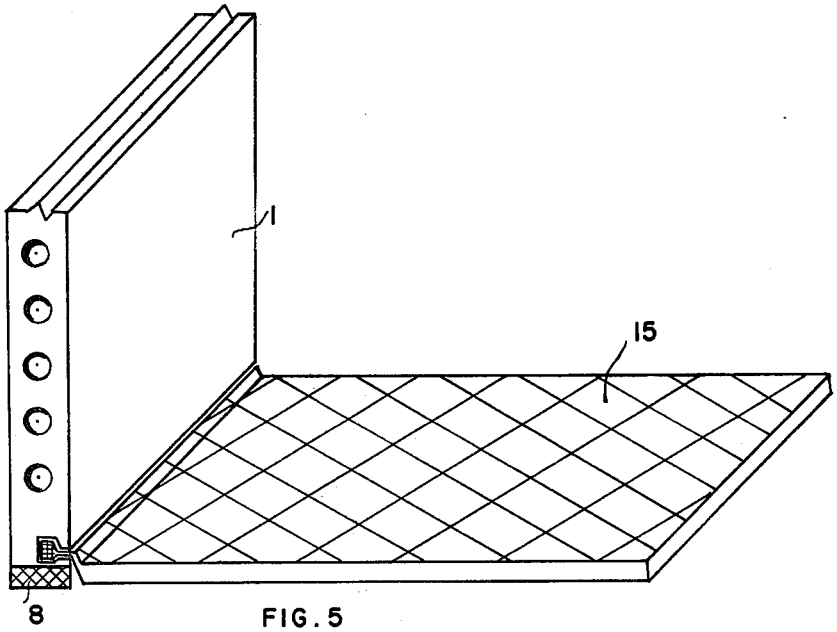
FIG. 5 is a view showing a base member detachably connected to a resiliently deformable element of the Yoga exercising device.
Figure 10:
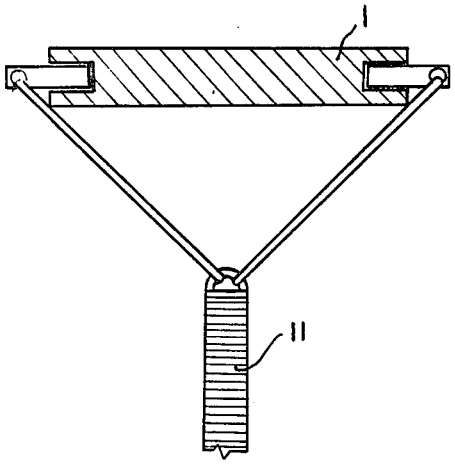
FIG. 10 is a view showing the connecting member connectable with the resiliently deformable element.

As shown in FIG. 3, the deformable element 1 can be bent so that it assumes a concave contour, and a connecting member 11 may be connected thereto in a plurality of locations, as shown in FIG. 10 of the drawings. When the practitioner grasps a handle element 12 by his or her hands, his or her body is urged to bend under the action of the deformable element 1 which tends to become straight. As shown in FIG. 3, the practitioner places his or her body on a portion of the deformable element 1.

Figure 6:
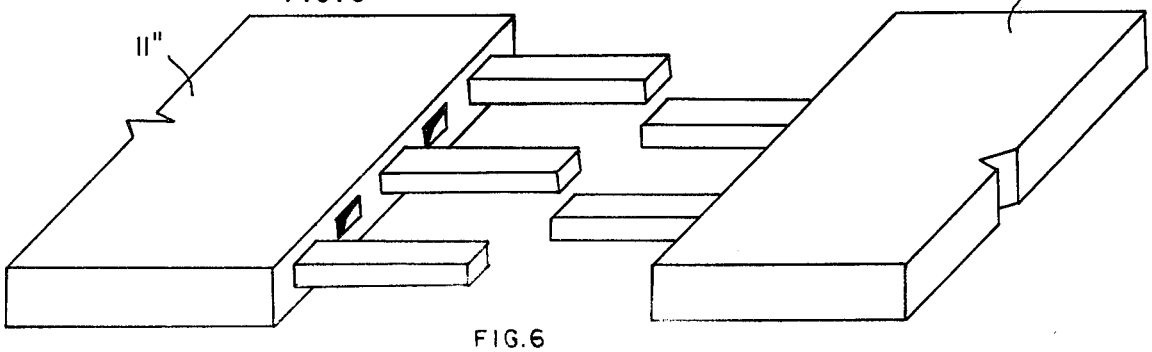
FIG. 6 is a view showing a resiliently deformable element of the Yoga exercising device including two sections detachbly connectable with one another.
Figure 7:
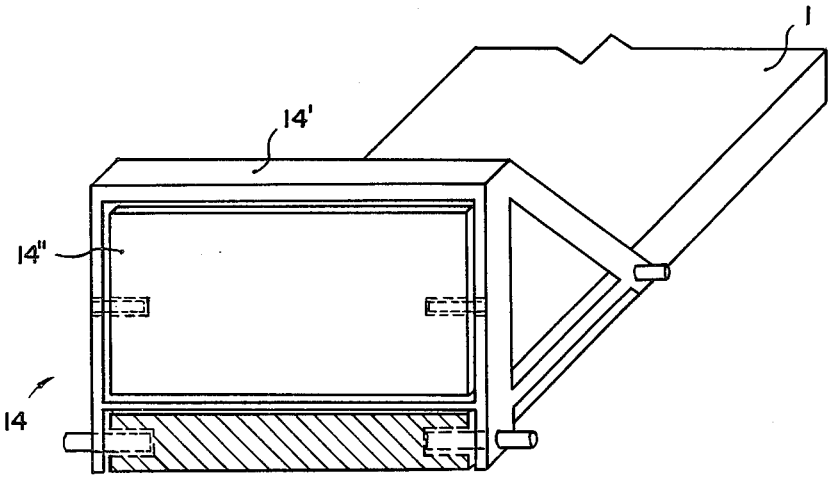
FIG. 7 is a view showing a stop member of the Yoga exercising device.
Figure 8:
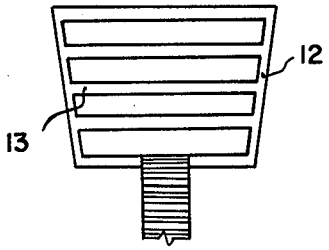
FIG. 8 is a view showing a handle element of the Yoga exercising device, connected with a connecting member.

The deformable element 1 may have two separate sections 11' and 11'' detachably connectable with one another, as shown in FIG. 6. Thus-formed element can be easily dismounted so that each separate section can be utilised for execution of the above third posture, that is Paschimotasana. At the same time, the device become compact and occupies a comparatively small space, for instance, for transportation. As shown in FIG. 8, the handle element 12 has several grasping members 13 spaced from one another in the direction of elongation of the connecting member 11. By grasping a respective member 13 and by insertion of the connecting member 11 into respective bore 4 of the deformable element 1, the practitioner may vary stress applied thereto. The connecting member may also be adjustable in length.

A stop member identified in toto by reference numeral 14 can be detachably mounted in the respective bores 4 of the deformable element 1 so that the practitioner's feet can abut thereagainst. The stop member 14 has a body portion 14', and a portion 14'' angularly movable relative to the body portion 14'. When the deformable element 1 is bent so as to assume its concave contour in the third position and the body portion 14 of the stop member 14 changes its position, the movable portion 14'' can turn so that the practitioner's soles will conveniently rest on the portion 14''. By vatying of location of the stop member the practitioner may vary stress applied thereto. The stop member 14 is provided with pin-shaped projections insertable in the bores 4 of the resiliently deformable element 1.

A base member 15 may be detachably connected to the end portion of the deformable element 1 in the second position The practitioner may sit or lie down on the base member 15 and thereupon start exercising. The base member cannot move away owing to the practitioner's weight applied thereto, and therefore the deformable element 1 is prevented from moving away from the practitioner. One or both face surfaces of the base member 15 may be provided with engaging formations so as to prevent slipping of the base member 15 relative to a floor and the like or/and slipping of the practitioner's body relative to the base member.

The connecting element 2 may be adjustable in the direction of elongation thereof. For instance, the connecting element may be composed of two or more separate sections, such as 2' and 2'' which telescopically move relative to one another and are fixed in a plurality of mutual positions so that the length of the connecting element 2 may be varied. By varying of length of the connecting element 2 the curvature of the resiliently deformable element 1 so that the practitioner can vary the curvature of his or her body in the bow-like posture, or to vary an angle of inclination of his or her body in the candle-like posture. In the latter case, the practitioner can gradually master a plurality of postures, starting from a posture with a small angle of inclination, and thereupon can gradually increase this angle. The connecting element 2 must have rigidity exceeding the rigidity of the deformable element 1 so as to brace the latter in a respective position.

The deformable element 1 in an initial or inoperative position may have a substantially rectilinear contour which subsequently will be changed by bending of the deformable element 1 into a respective position. It is to be understood that the practitioner can bend the deformable element 1 by himself or herself. On the other hand, the deformable element 1 may have in the initial condition a concave contour. In the latter case the deformable element 1 must be bent by the practitioner into a more curved contour as compared with that in the initial position. A radius of curvature of the deformable element 1 in the third position will be smaller than that of in the initial position, and therefore the practitioner will be urged by the element 1 to bend forward The deformable element 1 may be adjustable in the direction of elongation thereof so as to vary its length. This can be done by means which are similar to the means shown in FIG. 6 for connecting element 2, or by other conventional means.

While it will be apparent that the preferred embodiments of the invention herein disclosed are well calculated to fulfill the objects above stated, it will be appreciated that the invention is susceptible to modifications, variations and changes without departing from the proper scope or fair meaning of the subjoined claim. The device may also be used for executing other Yoga exercises which differ from those described above.

What is intended to be protected by a Letters Patent is:

1. A Yoga exercising device, comprising an elongated resiliently deformable element movable to a position in which it assumes a concave contour and is fixedly retained in said position so that when the body of a practitioner is placed inside said concavely deformed resiliently deformable element the practitioner's body assumes a bow-like posture under the action of the concave contour of said resiliently deformable element, said resiliently deformable element having an initial position from which it is moved into said first-mentioned position and in which it has a substantially rectilinear contour; and means for retaining said resiliently deformable element in said first-mentioned position and said retaining means includes an elongated connecting element detachably bracing said resiliently deformable element from inside in said position.

2. The device as defined in claim 1, wherein said connecting element has a rigidity exceeding the rigidity of said resiliently deformable element.

3. The device as defined in claim 1, wherein said resiliently deformable element has two ends spaced from one another in the direction of elongation thereof, said connecting element being detachably connected with said resiliently deformable element in the regions of said ends of the deformable element.

4. The device as defined in claim 1; and further comprising means for connecting said other section of said connecting element to said resiliently deformable element in a plurality of locations on said deformable element between said intersection of central plane and the other end of the deformable element.

5. The device as defined in claim 1, wherein said resiliently deformable element has two ends spaced from one another in the direction of elongation thereof, a central plane spaced equidistant from said ends, and a portion of said deformable element being located between the intersection of said central plane and a respective one of said ends, said connecting element having two end sections spaced from one another in the direction of elongation thereof, one of said sections of said connecting element being connected to said resiliently deformable element in the region of one of said ends of the latter, and the other section of said connecting element being connected to said resiliently deformable element in the region located between said central plane and the other end of the deformable element.

6. The device as defined in claim 1, wherein said resiliently deformable element includes at least two resiliently deformable members connectable with one another so as to form together said resiliently deformable element.

7. The device as defined in claim 1, wherein said resiliently deformable element is resiliently deformable under the action of the practitioner's body in the first mentioned position.

8. The device as defined in claim 1, wherein said resiliently deformable element is bendable to a plurality of positions so as to assume a plurality of concave contours having differing radii of curvature.

9. A Yoga exercising device, comprising an elongated resiliently deformable element movable to a position in which it assumes a concave contour and is fixedly retained in said position so that when the body of practitioner is placed inside said concavely deformed resiliently deformable element the practitioner's body assumes a bow-like posture under the action of the concave contour of said resiliently deformable element, said resiliently deformable element having an initial position from which it is moved into said first-mentioned position and in which it is substantially curved and has a first radius of curvature, said resiliently deformable elements having in said first-mentioned position a second radius of curvature which is smaller than said first radius of curvature; and means for retaining said resiliently deformable element in said first-mentioned position, said connecting element is adjustable in the direction of elongation thereof so as to vary its length; and said connecting element further comprises means for adjusting and fixing the length of said connecting element.

* * * * *